US005374602A

United States Patent [19]

Defieuw et al.

[11] Patent Number: 5,374,602

[45] Date of Patent: Dec. 20, 1994

[54] DYE-DONOR ELEMENTS FOR THERMAL DYE TRANSFER

[75] Inventors: Geert Defieuw, Kessel-Lo; Emiel Verdonck, Berlaar, both of Belgium

[73] Assignee: AGFA-GEVAERT, N.V., Mortsel, Belgium

[21] Appl. No.: 983,709

[22] Filed: Dec. 1, 1992

[30] Foreign Application Priority Data

Jan. 28, 1992 [EP] European Pat. Off. ..... 92200229

[51] Int. Cl.[5] ..... B41M 5/035; B41M 5/38

[52] U.S. Cl. ..... 503/227; 428/195; 428/207; 428/331; 428/447; 428/913; 428/914

[58] Field of Search ..... 8/471; 428/195, 207, 428/323, 330, 484, 500, 522, 913, 914, 331, 447; 503/227

[56] References Cited

U.S. PATENT DOCUMENTS 4,740,496 4/1988 Vanier ..... 503/227
4,829,050 5/1989 Henzel et al. ..... 503/227
4,853,367 8/1989 Henzel et al. .

FOREIGN PATENT DOCUMENTS 60-82393 5/1985 Japan ..... 503/227
1175090 8/1986 Japan ..... 503/227
3145077 6/1988 Japan ..... 503/227

*Primary Examiner*—B. Hamilton Hess
*Attorney, Agent, or Firm*—Breiner & Breiner

[57] ABSTRACT

Dye-donor element for use according to thermal dye transfer methods comprising a support having on one side thereof a dye/binder layer comprising a dye, a binder comprising a copolymer comprising styrene units and acrylonitrile units, and uniformly distributed solid particles, wherein said copolymer comprises at least 15% by weight of acrylonitrile units and said solid particles are selected from the group consisting of solid waxes, calcium carbonate, and polydimethylsilylsesquioxan.

1 Claim, No Drawings

DYE-DONOR ELEMENTS FOR THERMAL DYE TRANSFER

DESCRIPTION

1. Field of the Invention

The present invention relates to dye-donor elements for use according to thermal dye sublimation transfer.

2. Background of the Invention

Thermal dye transfer methods include thermal dye sublimation transfer also called thermal dye diffusion transfer. This is a recording method in which a dye-donor element provided with a dye/binder layer containing sublimating dyes having heat transferability is brought into contact with a receiver sheet and selectively, in accordance with a pattern information signal, heated with a thermal printing head provided with a plurality of juxtaposed heat-generating resistors, whereby dye is transferred from the selectively heated regions of the dye-donor element to the receiver sheet and forms a pattern thereon, the shape and density of which are in accordance with the pattern and intensity of heat applied to the dye-donor element.

A dye-donor element for use according to thermal dye sublimation transfer usually comprises a very thin support e.g. a polyester support, one side of which is covered with a dye/binder layer comprising the printing dyes in a form that can be released in varying amounts depending on how much heat is applied to the dye-donor element.

The dye in the dye/binder layer is usually carried by a binder. Known binder resins are cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, and cellulose triacetate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; copolymers of styrene and acrylonitrile; polysulfones; polyphenylene oxide; organosilicones such as polysiloxanes; epoxy resins and natural resins, such as gum arabic.

The dye/binder layer comprising dye(s) carried by a binder may be coated from a solution in appropriate solvents on the subbed support, but the known coating techniques are not quite adapted to the discontinuous coating of differently coloured dye/binder areas on said very thin support. It is therefore customary, especially in large-scale manufacturing conditions, to print said dye/binder layer on said support by printing techniques such as a gravure process.

However, most binders have one or more disadvantages. For instance, some binders have a low viscosity and thus form a dye/binder composition that does not have an ink-like nature and as a consequence is not printable. Other binders have a suitable viscosity, but are soluble only in solvents such as chlorinated hydrocarbon solvents, which are rejected nowadays from an ecological. standpoint.

Another disadvantage of some binders is that when heat is supplied by the thermal printing head to the dye-donor element, the dye/binder layer melts and consequently starts sticking to the receiver sheet. This sticking eventually results in the tearing off of the dye/-binder layer.

Certain binders cause dye crystallization, which is to be avoided since it prevents effective thermal dye transfer and consequently produces erratic print densities and printing fog on the receiver sheet.

Copolymers of styrene and acrylonitrile are indeed binders that are excellent for preventing crystallization of the dye(s) present in the dye/binder layer, especially when a high ratio of dye(s) is used in respect of the binder. Unfortunately, dye-donor elements comprising a dye/binder layer containing such copolymers of styrene and acrylonitrile as binders have the disadvantage that—when stored or kept in rolled-up condition on reels or spools in cartridges—the side showing the dye/binder layer tends to stick to the contacting rear side of the dye-donor element. This sticking may result in tearing off of parts of the dye/binder layer.

3. Summary of the Invention

It is therefore an object of the present invention to provide dye-donor elements that remain substantially free from crystallization during storage, the dye/binder layer side of said dye-donor elements being free from sticking to the rear side of the dye-donor elements when these are kept or stored in rolled-up condition.

It is another object of the present invention to provide a method of forming an image by thermal transfer of dyes from a dye-donor element to a receiver sheet, the transferred image on the receiver sheet having faultless high densities.

Further objects will become apparent from the description hereinafter.

According to the present invention a dye-donor element for use according to thermal dye transfer methods is provided, said element comprising a support having on one side thereof a dye/binder layer comprising at least one dye carried by a binder comprising a copolymer comprising styrene units and acrylonitrile units and uniformly distributed solid particles, wherein said copolymer comprises at least 15% by weight of acrylonitrile units and said solid particles are selected from the group consisting of solid waxes, calcium carbonate, preferably acicular calcium carbonate, and polydimethylsilylsesquioxan.

By the expression "solid waxes" as used herein waxes are meant, which are in solid state at room temperature, which in the liquid state have a viscosity under 8000 mPa s, and which preferably do not dissolve in the solvents e.g. ethyl methyl ketone used for dissolving the dye(s) and the binder comprising said copolymer comprising styrene units and acrylonitrile units.

The present invention further provides a method of forming an image having substantially faultless high densities by:

image-wise heating a dye-donor element comprising a support having thereon a dye/binder layer comprising at least one dye, a binder comprising a copolymer comprising styreno units and acrylonitrile units, and uniformly distributed solid particles, wherein said copolymer comprises at least 15% by weight of acrylonitrile units and said solid particles are selected from the group consisting of solid waxes, calcium carbonate, preferably acicular calcium carbonate, and polydimethylsilylsesquioxan, and causing transfer of the image-wise heated dye to a receiver sheet.

4. Detailed Description of the Invention

In adjacent windings of a dye-donor element in rolled-up condition, the dye/binder layer in one winding of the roll faces the rear face of the adjacent winding of the dye-donor element. As a consequence, the dye and the binder comprising a copolymer comprising styrene units and acrylonitrile units would be in direct contact with the back layer of the dye-donor element and as mentioned above would tend to stick to the back layer if the protruding particles according to the present invention were not used.

The solid particles are uniformly distributed throughout the dye/binder layer and have an average particle size exceeding the thickness of said dye/binder layer so as to protrude from the surface of said layer. During the image-wise heating of the dye-donor element they may remain fixed in the dye/binder layer or they may transfer to the receiver sheet.

The solid particles used in accordance with the present invention preferably have an average particle size ranging from 0.3 to 40 μm, and more preferably from 1.5 to 8 μm.

The wax used for the purpose of the present invention can be any of the water-insoluble thermoplastic wax-like materials of the known six classes of waxes i.e. vegetable waxes, insect waxes, animal waxes, mineral waxes, petroleum waxes, synthetic waxes, as well as the water-insoluble wax-like components that occur individually in these waxes, more particularly long-chain hydrocarbons, saturated, unsaturated, branched, and unbranched fatty acids and alcohols, as well as the ethers and esters of aliphatic monohydric alcohols.

Preferentially, the solid waxes used in accordance with the present invention are selected from the group consisting of polyolefin waxes, ester waxes, and amide waxes. According to an even more preferred embodiment the solid polyolefin wax is a polyethylene wax. According to another more preferred embodiment the amide wax is an ethylene-bis-stearamide wax such as Ceridest 3910 (trade name) Hoechst, Germany.

For more details about waxes and wax-like thermoplastic materials there can be referred to "The Chemistry and Technology of Waxes", by A. H. Warth, 2nd Ed., 1956, Reinhold Publishing Corporation, New York, U.S.A. and to "Industrial Waxes" Vol. I, by H. Bennett, 1963, Chemical Publishing Company Inc., New York, U.S.A.

The wax used according to the present invention should, of course, be chemically inert towards the other ingredients of the dye/binder layer. Preferably, it does not dissolve together with the binder and the dye(s) in the solvent or solvent mixture used to form a coating or printing composition that is applied to a support, which may have been provided first with an adhesive or subbing layer.

Sometimes it may be advantageous to combine two or more waxes.

Examples of solid wax particles that can be used according to the present invention in combination with the binder comprising a copolymer comprising styrene units and at least 15% by weight of acrylonitrile units are the following:

Polyolefin wax particles consisting of or comprising:

Hordamer PE03 (polyethylene latex) supplied by Hoechst, Germany,

Perapret PE40 (polyethylene latex) supplied by BASF, Ludwigshaven, Germany,

Lancowax PE1544 (polyethylene particles of 1 to 10 μm and melting point 130° C.), supplied by Langer, Crayvalley, Belgium, Lancowax PE1500 (polyethylene particles of 4 μm and melting point 110° C.) also supplied by Langer, Aqua Poly AP250 (polyethylene particles smaller than 13 μm and melting point between 117° and 123° C.) supplied by Floridienne, Brussels, Belgium, Micronised synthetic waxes MP22C (polyethylene particles smaller than 10 μm and melting point between 101° and 106° C.) and 620XF (polyethylene particles smaller than 8 μm and melting potent 110° C.) both supplied by Floridienne, Brussels, Belgium, Microthene FN500 (polyethylene particles of about 20 μm and melting point between 96° and 112° C.) and FN510 (polyethylene particles of about 30 μm and melting point 97° C.) both supplied by USI, Antwerp, Belgium, Ceracol 39 (polyethylene particles of 5 to 8 μm) supplied by Cera Chemie, Deventer, The Netherlands, Polymist A12 (polyethylene particles of 5 to 40 μm and melting point 138° C.) supplied by Allied Colloids, Nijvel, Belgium, and Ceridust 3620, 130, 9610 F, 9615A, 9630F all supplied by Hoechst, Germany;

Amide wax particles consisting of or comprising:

Ceridust 3910 supplied by Hoechst, Germany.

Examples of calcium carbonate particles that can be used according to the present invention in combination with the binder comprising a copolymer comprising styrene units and at least 15% by weight of acrylonitrile units are the following:

Socal N6 and Socal N2, both marketed by Solvay, Belgium

Examples of polydimethylsilylsesquioxan particles that can be used according to the present invention in combination with the binder comprising a copolymer comprising styrene units and at least 15% by weight of acrylonitrile units are the following:

Tospearl 120, Tospearl 145, Tospearl 240, Tospearl 108, and Tospearl 130, all being supplied by General Electric, The Netherlands. Tospearl 120 and Tospearl 145 are highly preferred four use according to the present invention.

The polydimethylsilylsesquioxan particles are also effective in reducing the sticking tendency of dye/-binder layers comprising other binders known in the art such as e.g. polyvinyl acetal, cellulose acetate propionate, cellulose acetate butyrate, and ethylcellulose. Even though the latter binders may cause more crystallization of the dye(s) in the dye/binder layer, they can still be used for dyes or dye mixtures that exhibit a lower intrinsic degree of crystallization. The polydimethylsilylsesquioxan particles are especially useful for obtaining uniform densities over the whole density scale when combined with the above-mentioned known binders.

It may be advantageous to use a mixture of different types of particles selected from the group consisting of solid waxes, calcium carbonate, and polydimethylsilylsesquioxan. It is even possible to use a mixture of particles selected from the group consisting of solid waxes, calcium carbonate, and polydimethylsilylsesquioxan with solid particles of other classes.

Preferentially, the binder comprising a copolymer comprising styrene units and acrylonitrile units for use in the dye/binder layer according to the present invention comprises at least 60% by weight of styrene units and at least 25% by weight of acrylonitrile units binder. The binder copolymer may, of course, comprise other comonomers than styrene units and acrylonitrile units provided that a sufficient number of acrylonitrile units are present. Suitable other comonomers are e.g. butadiene, butyl acrylate, and methyl methacrylate. The binder copolymer preferably has a glass transition temperature of at least 50° C.

It is, of course, possible to use a mixture of the copolymer comprising styrene units and at least 15% by weight of acrylonitrile units with another binder known in the art, provided that said binder copolymer is present in an amount of at least 50% by weight of the total amount of binder. A binder that can be used advantageously in admixture with said binder copolymer is a toluene sulfonamide formaldehyde condensation product as described in the European patent application no. 92201621.7 and in the corresponding U.S. Pat. No. 5,342,820. Such condensation products are e.g. the commercially available Ketjenflex MH and Ketjenflex MS-80 (Akzo, The Netherlands).

The dye/binder layer comprises at least 35% by weight of sublimable dyes.

The dye/binder layer generally has a thickness of about 0.2 to 5.0 μm, preferably 0.4 to 2.0 μm, and the amount ratio of dye to binder generally ranges from 9:1 to 1:3 weight, preferably from 3:1 to 1:2 by weight.

Any dye or mixture of dyes can be used in the dye/-binder layer provided it is easily transferable to the dye-image-receiving layer of the receiver sheet by the action of heat.

Typical and specific examples of dyes for use in thermal dye sublimation transfer have been described in e.g. EP 400,706, EP 209,990, EP 216,483, EP 218,397, EP 227,095, EP 227,096, EP 229,374, EP 235,939, EP 247,737, EP 257,577, EP 257,580, EP 258,856, EP 279,330, EP 279,467, EP 285,665, U.S. Pat. No. 4,743,582, U.S. Pat. No. 4,753,922, U.S. Pat. No. 4,753,923, U.S. Pat. No. 4,757,046, U.S. Pat. No. 4,769,360, U.S. Pat. No. 4,771,035, JP 84/78,894, JP 84/78,895, JP 84/78,896, JP 84/227,490, JP 84/227,948, JP 85/27,594, JP 85/30,391, JP 85/229,787, JP 85/229,789, JP 85/229,790, JP 85/229,791, JP 85/229,792, JP 85/229,793, JP 85/229,795, JP 86/268,493, JP 86/268,494, JP 85/268,495, and JP 86/284,489.

The coating composition for the dye/binder layer may also contain other additives, such as curing agents, preservatives, dispersing agents, antistatic agents, defoaming agents, viscosity-controlling agents, these and other ingredients having been described more fully in EP 133,011, EP 133,012, EP 111,004, and EP 279,467.

Any material can be used as the support for the dye-donor element provided it is dimensionally stable and capable of withstanding the temperatures involved, up to 400° C. over a period of up to 20 ms, and is yet thin enough to transmit heat applied on one side through to the dye on the other side to effect transfer to the receiver sheet within such short periods, typically from 1 to 10 ms. Such materials include polyesters such as polyethylene terephthalate, polyamides, polyacrylates, polycarbonates, cellulose esters, fluorinated polymers, polyethers, polyacetals, polyolefins, polyimides, glassing paper and condenser paper. Preference is given to a support comprising polyethylene terephthalate. In general, the support has a thickness of 2 to 30 μm. The support may also be coated with an adhesive or subbing layer, if desired.

The dye/binder layer of the dye-donor element can be coated on the support or printed thereon by a printing technique such as a gravure process.

A dye-barrier layer comprising a hydrophilic polymer may also be employed between the support and the dye/binder layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacryiic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye/binder layer, so that the need for a separate adhesive or subbing layer is avoided. These particular hydrophilic polymers used in a single layer in the dye-donor element thus perform a dual function, hence are referred to as dye-barrier/subbing layers.

Preferably, the reverse side of the dye-donor element has been coated with a heat-resistant layer to prevent the printing head from sticking to the dye-donor element. Such a heat-resistant layer would comprise a lubricating material such as a surface-active agent, a liquid lubricant, a solid lubricant or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid exters. Suitable heat-resistant layers have been described in e.g. EP 138,483, EP 227,090, U.S. Pat. No. 4,567,113, U.S. Pat. No. 4,572,860, U.S. Pat. No. 4,717,711. Preferably the heat-resistant layer comprises a polycarbonate derived from a bis-(hydroxyphenyl)-cycloalkane (diphenol), e.g. 1,1-bis-(4-hydroxyphenyl)-3,3,5-trimethylcyclohexane, as described in European patent application no. 91202071.6 and in the corresponding U.S. Pat. No. 5,234,888, as binder and a slipping agent comprising polydimethylsiloxane as lubricant in an amount of 0.1 to 10% by weight of the binder or binder mixture. Other binders for the heat-resistant layer that can be used advantageously for improving the non-stickiness of thee dye-donor element in rolled-up state are i.a. cellulose acetate butyrate, cellulose acetate propionate, and cellulose nitrate. Suitable heat-resistant layers may also comprise cross-linked polymers for improving the non-stickiness of the dye-donor element in rolled-up state. The slipping agent may be coated in the form of a separate topcoat on top of said heat-resistant layer as described in the above-mentioned European patent application no. 9120271.6 and in the corresponding U.S. Pat. No. 5,234,888.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polystyrene-co-acrylonitrile, polycaprolactone, preferably polyvinyl chloride, or mixtures thereof. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, EP 227,094, and EP 228,066.

In order to improve the light-fastness and other stabilities of recorded images UV-absorbers, singlet oxygen quenchers such as HALS-compounds (Hindered Amine Light Stabilizers) and/or antioxidants can be incorporated into the dye-image-receiving layer.

The dye/binder layer of the dye-donor element or the dye-image-receiving layer of the receiver sheet may also contain a releasing agent that aids in separating the dye-donor element from the receiver sheet after transfer. The releasing agents can also be incorporated in a separate layer on at least part of the dye/binder layer and/or of the dye-image-receiving layer. Suitable releasing agents are solid waxes, fluorine- or phosphate-containing surface-active agents and silicone oils. Suitable releasing agents have been described in e.g. EP 133,012, JP 85/19,138, and EP 227,092.

The dye-donor elements according to the invention are used to form a dye transfer image, which process comprises placing the dye/binder layer of the dye-donor element in face-to-face relation with the dye-image-receiving layer of the receiver sheet and image-wise heating from the back of the dye-donor element. The transfer of the dye is accomplished by heating for about several milliseconds at a temperature of 400° C.

When the process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

In addition to thermal heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye/-binder layer or another layer of the dye element has to contain a compound that absorbs the light emitted by the laser and converts it into heat e.g. carbon black.

Alternatively, the support of the dye-donor element may be an electrically resistive ribbon consisting of e.g. a multilayer structure of a carbon-loaded polycarbonate coated with a thin aluminum film. Current is injected into the resistive ribbon by electrically addressing a printing head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology as compared to the thermal head technology, according to which the various elements of the thermal head get hot and must cool down before the head can move to the next printing position.

The following examples illustrate the invention in more detail without, however, limiting the scope thereof.

EXAMPLE 1

Selection of the Binder

A series I of dye-donor elements for use according to thermal dye sublimation transfer were prepared as follows.

A polyethylene terephthalate film support having a thickness of 5.7 μm was coated on both sides with a solution of 1% by weight of an aromatic copolyester essentially consisting of terephthalic acid, isophthalic acid, ethylene glycol, adipic acid, neopentyl glycol, and glycerol in ethyl methyl ketone to form on both sides a subbing layer having a wet thickness of 10 μm.

A dye composition forming black was prepared by dissolving 2.4% by weight of dye A, 6% by weight of dye B, 2% by weight of dye C, 6.4% by weight of dye D in ethyl methyl ketone, and 8% by weight of binder as identified in Table 1 hereinafter, and dispersing therein 1% by weight of the above-identified amide wax Ceridust 3910.

Dye A

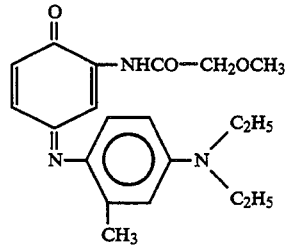

Dye B

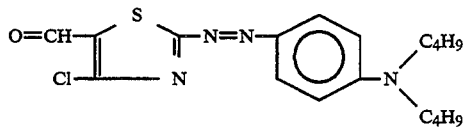

Dye C

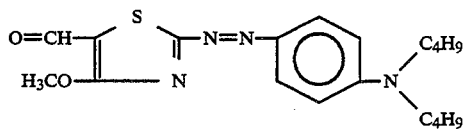

-continued

Dye D

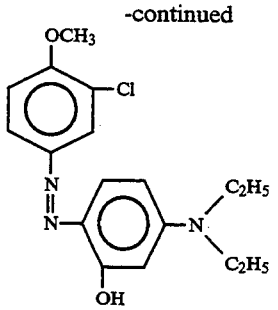

The resulting composition was coated on one side of the subbed support to form a dye/binder layer thereon having a wet thickness of 10 μm. The resulting dye/-binder layer was dried by evaporation of the solvent.

The subbed opposite side of the film support was covered with a solution in methyl ethyl ketone of 13% by weight of a polycarbonate having the following structural formula to form a heat-resistant layer :

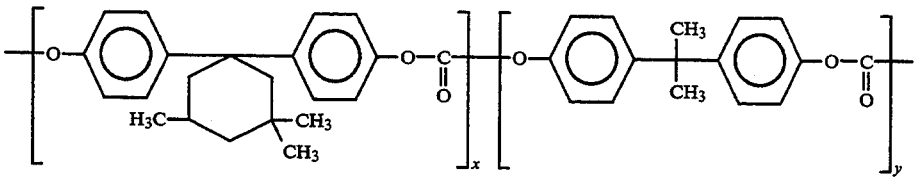

wherein x=55 mol% and y=45 mol%.

Finally, a top layer having a wet thickness of 10 μm was coated from a 0.5% by weight solution of polyether-modified polydimethylsiloxane (Tegoglide 410, Goldschmidt) in isopropanol on the resulting heat-resistant polycarbonate layer.

An analogous series 2 of dye-donor elements was made in exactly the same way as described above with the only difference that instead of the dye/binder layer for forming black a dye/binder layer for forming magenta was coated from a composition prepared by dissolving 12% by weight of dye E and 10% by weight of binder as identified in Table 1 hereinafter, and dispersing therein 1% by weight of the above-identified amide was Ceridust 3910.

Dye E

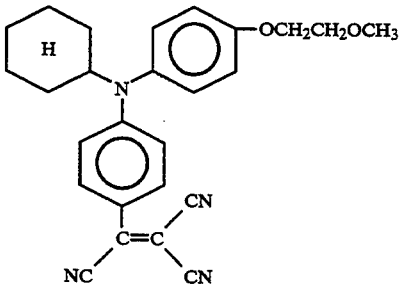

The dye-donor elements of series 1 having a black-forming dye mixture were all identical, except for the binder in the dye/binder layer and the dye-donor elements of series 2 having a magenta-forming dye were also identical, also except for the binder in their dye/-binder layer. The different binders were tested to evaluate their behavior with respect to causing unwanted dye crystallization. The evaluation was made after 7 days of storage of each dye-donor element in rolledup state of 45° C. and a relative humidity of 70%. The evaluation was made by visual and microscopic inspection of each dye-donor element. Four evaluation levels of dye crystallization could be attributed:

| | |
|---|---|
| Bad | meaning that crystallization was extensive |
| Moderate | meaning that crystallization was still too high |
| Good | meaning that crystallization was acceptable |
| Excellent | meaning that there was no visible crystallization |

In Table 1 hereinafter the different binders tested and the result obtained therewith with respect to dye crystallization are listed, both for the series 1 (black) and for the series 2 (magenta) elements.

TABLE 1

| Binder | Black | Magenta |
|---|---|---|
| According to the invention | | |
| SAN 2 (invention) | good | good |
| SAN 3 (invention) | excellent | excellent |
| SAN 4 (invention) | excellent | excellent |
| Comparison | | |
| SAN 1 | moderate | moderate |
| Polystyrene - Suprapal LR8404 (BASF, Germany) | bad | moderate |
| Ethyl cellulose - N7 (Hercules) | bad | moderate |
| Cellulose acetate butyrate - CAB 171 15 (Eastman Chemicals) | bad | bad |
| Cellulose acetate propionate - PLFS 130 (Celanese) | bad | bad |
| Polyvinyl butyral - Pioloform BL18 (Wacker Chemie) | bad | bad |
| Copolyester ** | bad | bad |

SAN 1 stands for co(styrene/acrylonitrile) prepared by emulsion polymerization and comprising 10% by weight of acrylonitrile units
SAN 2 stands for co(styrene/acrylonitrile) prepared by emulsion polymerization and comprising 25% by weight of acrylonitrile units
SAN 3 stands for co(styrene/acrylonitrile) prepared by emulsion polymerization and comprising 35% by weight of acrylonitrile units
SAN 4 stands for co(styrene/acrylonitrile) comprising 35% by weight of acrylonitrile units; sold under the trade name Luran 388S by BASF
Copolyester  stands for an aromatic copolyester essentially consisting of terephthalic acid, isophthalic acid, ethylene glycol, adipic acid, neopentyl glycol, and glycerol SAN 1 stands for co (styrene/acrylonitrile) prepared by emulsion polymerization and comprising 10% by weight of acrylonitrile units SAN 2 stands for co (styrene/acrylonitrile) prepared by emulsion polymerization and comprising 25% by weight of acrylonitrile units SAN 3 stands for co (styrene/acrylonitrile) prepared by emulsion polymerization and comprising 35% by weight of acrylonitrile units SAN 4 stands for co(styrene/acrylonitrile) comprising 35% by weight of acrylonitrile units; sold under the trade name Luran 388S by BASF Copolyester  stands for an aromatic copolyester essentially consisting of terephthalic acid, isophthalic acid, ethylene glycol, adipic acid, neopentyl glycol, and glycerol These results show that the use of SAN 2, which is a binder copolymer comprising at least 15% by weight of acrylonitrile units, guarantees low crystallization values in the case high dye/binder ratios and that the use of SAN 3 and SAN 4, which are binder copolymers comprising at least 25% by weight of acrylonitrile units, guarantees even inexistent crystallization values.

EXAMPLE 2

Selection of the Solid Particles

A series of dye-donor elements comprising a dye/-binder layer for forming black were prepared as described in Example 1, with the proviso that the binder (8% by weight of the coating composition for forming the dye/binder layer) was SAN 4 (which is the above-mentioned Luran 388S (trade name) marketed by BASF and which comprises 35% by weight of acrylonitrile units) and that different solid particles as specified in Table 2 hereinafter are used instead of the amide wax Ceridust 3910. The amounts of the solid particles used are also indicated in Table 2 (in % by weight of the coating composition for forming the dye/binder layer). The average particle size of the solid particles is given in μm in Table 2.

The different solid particles were tested to evaluate their behavior with respect to causing unwanted sticking of the side showing the dye/binder layer to the contacting rear side of the dye-donor element in rolled-up state.

The sticking behavior was assessed after 7 days of storage of each dye-donor element in rolled-up state at 45° C. and a relative humidity of 70%. The evaluation was made by visual inspection of each dye-donor element after unwinding. Four evaluation levels of sticking behavior could be attributed:

| | |
|---|---|
| Bad (B) | meaning that sticking was strong |
| Moderate (M) | meaning that sticking was still too strong |
| Good (G) | meaning that sticking was acceptable |
| Excellent (E) | meaning that there was no sticking at all |

TABLE 2

| | average particle size (μm) | % | Sticking |
|---|---|---|---|
| Particles according to the invention | | | |
| Micronized polyethylene wax 620XF Floridienne (Belgium) | 2.5 | 1 | E |
| Micronized amide wax Ceridust 3910 Hoechst (Germany) | 4.5 | 1 | E |
| Micronized amide wax Ceridust 3910 Hoechst (Germany) | 4.5 | 0.5 | G |
| Polyethylene wax Lancowax PE150OF Langer | 3.0 | 1 | E |
| Polyethylene wax Ceridust 9610 Hoechst (Germany) | <22 | 1 | E |
| Micronized amide wax Lancowax A1601 Langer | * | 1 | E |
| Cerafak 143 Cera Chemie (Belgium) | * | 1 | E |
| Polyethylene wax Ceracol 99 Cera Chemie (Belgium) | * | 1 | E |
| Calcium carbonate Socal N6 Needle length: 1-3 μm; width: 0.2-0.8 μm Solvay (Belgium) | | 0.5 | G |
| Calcium carbonate Socal N2 Needle length: 1-3 μm; width: 0.2-0.8 μm | | 0.5 | G |
| Calcium carbonate Socal N2 Needle length: 1-3 μm; width: 0.2-0.8 μm | | 0.5 | G |
| Mixture of - Calcium carbonate Socal N6 with - Micronized amide wax Ceridust 3910 | | 0.35<br>0.75 | E |

TABLE 2-continued

| | average particle size (μm) | % | Sticking |
|---|---|---|---|
| Polydimethylsilylsesquioxan Tospearl 240 General Electric (Netherlands) | 4 | 0.5 | E |
| Polydimethylsilylsesquioxan Tospearl 120 General Electric (Netherlands) | 2 | 1 | E |
| Comparison particles | | | |
| Syloid 378 silica particles Grace Davidson | 4 | 0.5 | E |
| Micro Ace P3 Talc particles Interorgana (Germany) | 2.4 | 0.5 | B |
| Hostaflon TF VP9202 teflon particles Hoechst (Germany) | 3-4 | 0.5 | B |
| None | — | 0 | B |

*no data available

The results listed in Table 2 show that solid particles used in accordance with the present invention prevent sticking of the side showing the dye/binder layer to the contacting rear side of the dye-donor element in rolled-up state.

EXAMPLE 3

A series of dye-donor elements as described in Example 2 were prepared.

Receiver sheets were prepared by coating a subbed polyethylene terephthalate film support having a thickness of 175 μm with a dye-image-receiving layer from a solution in ethyl methyl ketone of 3,6 g/m$^2$ of poly(vinyl chloride/co-vinyl acetate/co-vinyl alcohol) (Vinylite VAGD supplied by Union Carbide), 0,336 g/m$^2$ of diisocyanate (Desmodur N3300 supplied by Bayer AG), and 0,2 g/m$^2$ of hydroxy-modified polydimethylsiloxane (Tegomer H SI 2111 supplied by Goldschmidt).

Each dye-donor element, which as shown in Example 2, demonstrated no sticking in rolled-up state, was then used for printing in combination with a receiver sheet in a Mitsubishi colour video printer CP100E.

The receiver sheets were separated from the dye-donor elements and any possible presence of pinholes in the transferred image was checked visually and also given an evaluation level chosen from bad, moderate, good, and excellent. A pinhole is an area that is part of an image area onto which transfer of dye should have occurred but in which said transfer of dye was substantially inhibited.

Finally, the loss of density was determined by measuring the density values on the transferred images obtained from the above dye-donor elements and comparing these density values with those obtained from identical dye-donor elements having no particles in the dye/binder layer.

The loss of density was also evaluated with the levels bad (standing for a loss higher than 0.20), good (loss less than 0.20), and excellent (no loss).

The evaluation results for pinholes and loss of density are listed in Table 3 hereinafter.

The amounts of solid particles used are also indicated in Table 3 (in % by weight of the coating composition for forming the dye/binder layer).

In Table 3 the column "size" indicates the average particle size.

TABLE 3

| | Size | % | Pinholes | Density loss |
|---|---|---|---|---|
| Particles according to the invention | | | | |
| Micronized polyethylene wax 620XF | 2.5 | 1 | E | E |
| Micronized amide wax Ceridust 3910 | 4.5 | 1 | E | E |
| Micronized amide wax Ceridust 3910 | 4.5 | 0.5 | E | E |
| Polyethylene wax Lancowax PE1500F | 3.0 | 1 | E | E |
| Polyethylene wax Ceridust 9610 | <22 | 1 | E | E |
| Micronized amide wax Lancowax A1601 | — | 1 | E | E |
| Cerafak 143 | — | 1 | E | E |
| Polyethylene wax Ceracol 99 | — | 1 | E | E |
| Calcium carbonate Socal N6 Needle length:1–3 μm; width: 0.2–0.8 μm | | 0.5 | E | E |
| Calcium carbonate Socal N2 Needle length:1–3 μm; width: 0.2–0.8 μm | | 0.5 | E | E |

TABLE 3-continued

| | Size | % | Pinholes | Density loss |
|---|---|---|---|---|
| Mixture of Calcium carbonate Socal N6 with Micronized amide wax Ceridust 3910 | 4.5 | 0.35 0.75 | E | E |
| Polydimethylsilylsesquioxan Tospearl 240 | 4.0 | 0.5 | G | G |
| Polydimethylsilylsesquioxan Tospearl 120 | 2 | 1 | E | E |
| Comparison particles Syloid 378S silica particles | 4 | 0.5 | B | B |

These examples clearly demonstrate that only dye-donor elements according to the present invention in rolled-up state are stable and exhibit no crystallization of the dye or dye mixture so that the density and quality of the printed image obtained by thermal transfer from the dye-donor elements according to the present invention onto a receiver sheet are not affected.

We claim:

1. Dye-donor element for use according to thermal dye transfer methods comprising a support having on one side thereof a dye/binder layer comprising at least one dye carried by a binder and polydimethylsilylsesquioxan particles.

* * * * *